United States Patent [19]

Moraw et al.

[11] Patent Number: 4,482,241

[45] Date of Patent: Nov. 13, 1984

[54] DEVICE AND METHOD FOR STRIPPING DEVELOPER FROM A PHOTOCONDUCTIVE SURFACE

[75] Inventors: Roland Moraw; Günther Schädlich, both of Wiesbaden-Naurod, Fed. Rep. of Germany

[73] Assignee: Hoechst Aktiengesellschaft, Frankfurt am Main, Fed. Rep. of Germany

[21] Appl. No.: 482,534

[22] Filed: Apr. 6, 1983

[30] Foreign Application Priority Data

Apr. 15, 1982 [DE] Fed. Rep. of Germany ..... 3213798

[51] Int. Cl.[3] ..... G03G 15/10

[52] U.S. Cl. ..... 355/10; 118/661; 118/662; 355/77; 430/117

[58] Field of Search ..... 355/10, 4, 77; 118/661, 118/662, 261, 413, 414; 430/117–119

[56] References Cited

U.S. PATENT DOCUMENTS

| | | | |
|---|---|---|---|
| 3,229,787 | 1/1967 | Kolb et al. | 95/1.7 |
| 3,907,423 | 9/1975 | Hayashi et al. | 355/10 |
| 4,023,899 | 5/1977 | Hayashi et al. | 355/10 |
| 4,052,959 | 10/1977 | Hayashi et al. | 355/10 X |
| 4,161,361 | 7/1979 | Soma et al. | 355/10 |
| 4,236,483 | 12/1980 | Davis et al. | 430/117 X |
| 4,241,694 | 12/1980 | Cormier et al. | 355/10 X |
| 4,258,115 | 3/1981 | Magome et al. | 430/117 X |
| 4,286,039 | 8/1981 | Landa et al. | 430/119 |
| 4,325,627 | 4/1982 | Swidler et al. | 355/10 |
| 4,373,800 | 2/1983 | Kamiyama et al. | 355/10 |
| 4,411,976 | 10/1983 | Landa et al. | 430/119 X |

FOREIGN PATENT DOCUMENTS

| | | | |
|---|---|---|---|
| 2558451 | 7/1976 | Fed. Rep. of Germany | 355/10 |
| 10442 | 1/1978 | Japan | 355/10 |
| 38134 | 3/1979 | Japan | 355/10 |
| 88157 | 7/1981 | Japan | 355/10 |
| 210373 | 12/1982 | Japan | 355/10 |

*Primary Examiner*—R. L. Moses

*Attorney, Agent, or Firm*—Schwartz, Jeffery, Schwaab, Mack, Blumenthal & Koch

[57] ABSTRACT

In the device and method of the present invention, a stripping roller is positioned a short distance from an electrostatically charged photoconductor surface in an electrophotocopy machine. The roller is supplied with a bias voltage which has a polarity the same as that of the charge on the photoconductor surface and a magnitude which is equal to or higher than that of the photoconductor surface charge, but greater than 1 kV. The photoconductor surface is moved past the stripping roller to remove excess developer liquid.

16 Claims, 2 Drawing Figures

DEVICE AND METHOD FOR STRIPPING DEVELOPER FROM A PHOTOCONDUCTIVE SURFACE

BACKGROUND OF THE INVENTION

1. Field of the Invention

The present invention relates to an electrophotographic copying process and device in which a photoconductive surface is electrostatically charged and exposed to an information-carrying original to produce a latent charge-image. The latent charge-image obtained is developed by means of a developer liquid to produce a visible toner-image. Excess developer liquid is removed by a metering element which is located a short distance from the photoconductor surface and to which a bias voltage of the same polarity as that of the charged photoconductive surface is applied. The toner-image is transferred from the photoconductive surface onto a copying material, is fixed thereon, and the photoconductive surface is cleaned and/or discharged.

2. Discussion of Related Art

German Offenlegungsschrift No. 3,018,241 discloses a method for removing excess developer liquid from a photo-conductive surface on which an electrostatic charge-image has been developed. The developer is composed of a suspension of charged toner-particles in an insulating developer liquid. In the disclosed method, a drying element, in the form of a squeegee-roller or absorbent roller is brought into contact with the photoconductive surface. This squeegee-roller or absorbent roller is maintained at a potential having a polarity which is identical to that of the charge on the charged toner particles. In addition, the relative motion between the photoconductive surface and the squeegee-roller or absorbent roller is controlled to be zero in the contact region. The cylindrical surface of the squeegee-roller or absorbent roller is composed of an elastomeric material exhibiting a Shore-A hardness of less than 45 and a resistance value of less than $10^9$ Ohm.cm. The photoconductive surface is located on a drum which runs counterclockwise past a metering roller or stripping roller which is capable of limiting the quantity of liquid remaining on the photoconductor after the development of the latent charge-image. This metering roller or stripping roller does not touch the developed charge-image, so that neither streaks nor distortions are produced. After passing the metering or stripping roller, a layer of developer liquid with a thickness of between 10 and 15 μm remains on the photoconductor surface and the surface of the drum passes over the squeegee-roller roller or absorbent roller. The bias voltage on the squeegee-roller or absorbent roller produces an electric field which holds the toner firmly on the photoconductor surface. The bias voltage has the same polarity as the toner particles in the developer liquid; thus the developed image remains adhered to the photoconductor surface without producing streaks or smears, and without transfer of toner onto the squeegee-roller. After running past the squeegee-roller, the layer of liquid developer remaining on the photoconductor surface is reduced to a thickness of 2 to 3 μm, so that, overall, the thickness of the layer of developer liquid on the photoconductor is reduced to approximately a fifth of the initial value.

Apart from advantages, such as high resolution and low energy for fixing the copies, which the liquid developer method has as compared to the dry-developing technique, the liquid developer method also has the disadvantage that the copies have to be heated following the transfer of the toner image from the photoconductor surface onto the copying material. This is due to the fact that residual developer liquid remains on the copies and must be evaporated during the operation of fixing the copies by heating. As a result, large quantities of developer liquid are lost and must be continually completed in the copying apparatus. Also, due to this evaporation, the air in the vicinity of the copier becomes undesirably laden with evaporated developer liquid. Although the customary developer liquids are not toxic per se, since, in the majority of cases, they are aliphatic hydrocarbons such as i-decane in which the charged toner particles are dispersed, this large loss of developer liquid is undesirable because it leads to a certain level of environmental pollu- tion.

In the present state of the art as described, for example, in U.S. Pat. No. 3,907,423, the loss of developer liquid following the development of the charge-image on the photoconductive layer by electrophoretic deposition of charged toner particles is reduced by reducing the projecting excess thickness of the layer of developer liquid. This reduction in thickness is carried out before the toner image is transferred to the image receiving material by a stripping roller rotating counter to the rotation of the photoconductor. The stripping roller rotates at a high peripheral speed counter to the movement of the photoconductive layer at a distance of only approximately 50 μm from it. The toner-images deposited on the photoconductive layer are not smeared; however, only a portion of the projecting quantity of developer liquid is removed, so that moist copies are discharged.

The stripping roller or metering roller is separated from the photoconductor surface by a gap which has a width of 0.05 to 1 mm. As a result of the contrarotation of the metering roller at a peripheral speed which exceeds that of the photoconductive drum, the developer liquid is divided into two oppositely-directed flows in the metering gap between the photoconductor and the metering roller. One of these flows is sheared-off by the metering roller and removed by a wiper-blade located downstream. In the case of a metering gap of 100 μm, approximately 0.2 g of developer liquid is lost to one DIN A4 copy, so that the starting assumption can be made, on account of the linear relationship between the loss of developer liquid and the metering gap, that in the case of a gap of 50 μm the loss will amount to approximately 0.1 g of developer liquid.

The metering roller is retained in insulated bearing plates and a bias voltage of approximately 300 V develops on the roller as a result of induction. The image areas on the photoconductor surface are at an electrical potential of 900 to 950 V, while the image-free background areas are at an electrical potential of approximately 150 V. Since the metering roller is at an electrical potential which is lower than that of the image area and higher than that of the image-free areas on the photoconductor, the toner flows from the image-free areas to the image areas and is firmly retained at the latter.

Arrangements can also be made to apply a bias voltage to the metering roller by means of a source of direct voltage. This bias voltage is adjusted so that it is lower than the electrical potential at the image areas, and higher than the electrical potential at the image-free areas on the photoconductor surface. The sole effect of applying the bias voltage is a reduction in the background-shading of the copies and the achievement of a high-contrast image.

Up until very recently, repeated attempts have been made to remove excess developer liquid from the photoconductor surface after the development of the electro-static charge-image to effect a further reduction in the loss of developer liquid to the copies. In these attempts both absorbent rollers made of a foamed polymer with open pores and squeegee-rollers have been employed. The squeegee-roller technique is described, for example, in U.S. Pat. No. 3,299,787. This patent discloses the use of a squeegee-roller with an associated cleaning element for removing the excess developer liquid from a photoconductive belt.

It is not feasible to reduce the loss of developer liquid by increasing the peripheral speed of the metering roller due to the fact that the loss decreases only asymptotically as a function of the peripheral speed. Thus, the peripheral speed required to reduce a noticeable loss would be attainable only with great difficulty in conventional copiers. In addition, a noticeable reduction in the gap between the metering roller and the photoconductor-surface to less than 50 μm, which should result in a reduction in the loss of developer liquid, cannot be achieved due to the precision-engineering tolerances relating to the straightness of the photoconductive drum and of the metering roller. Compliance with specified precision-engineering tolerances becomes more difficult as the lengths of the photoconductive drum and of the metering roller are increased, in order, for example, to produce copies in the DIN A1 format. On account of greater bulging of the drums and metering rollers, the aim must be to employ gaps in excess of 50 μm for the production of large area copies, while at the same time attempting to reduce the loss of developer liquid.

SUMMARY OF THE INVENTION

One object of the present invention is to provide an improved electrophotographic device and process in which the loss of developer liquid to the copies is reduced.

Another object of the present invention is to provide an improved device and process for reducing the loss of developing liquid in which normal machining tolerances may be used in the manufacture of the electrophotographic system.

A further object of the present invention is to provide a device and method for reducing the loss of developing liquid wherein conventionally available components are used.

In accordance with the above and other objects, the present invention is an electrophotographic copying process comprising electrostatically charging a photoconductor surface and exposing the charged photoconductor surface to an information carrying original to obtain a latent charge image on the photoconductor surface. The latent image is developed by applying a developer liquid to the photoconductor surface to obtain a toner image and excess developer liquid is removed by a metering element to which a bias voltage having an absolute value greater than 1 kV and equal to or higher than the absolute value of the voltage on the charged photoconductor surface, has been applied. The polarity of the bias voltage is the same as that of the voltage on the charged photoconductor surface. The metering element is positioned a short distance from the photoconductor surface and the metering element and photoconductor surface are moved relative to one another. The toner image is then transferred from the photoconductor surface to a copying material and fixed on the copying material. The photoconductor surface is then cleaned and/or discharged.

The present invention also includes an electrophotographic copying device, comprising a photoconductor surface and means for electrostatically charging the photoconductor surface to form a charged photoconductor surface. The device also includes means for exposing the charged photoconductor surface to an information carrying original to form a latent charge image on the charged photoconductor surface and means for developing the latent charge image by applying a layer of developer liquid to the charged photoconductor surface to form a toner image. A stripping element is provided to remove excess liquid and a means is included for applying a bias voltage to the stripping element having an absolute value greater than 1 kV and equal to or higher than the absolute value of the voltage on the charged photoconductor surface and having polarity the same as the polarity of the voltage on the charged photoconductor surface. Means are included for moving the stripping element and the photoconductor surface relative to each other at a small distance apart to remove excess developer liquid from the photoconductor surface by contacting the liquid with the stripping element. Also, means are provided for transferring the toner image to a copy receiving material and for cleaning the photoconductor surface after the toner image has been transferred.

Through use of the present invention, the advantage of reduced developer loss is obtained as a result of applying a strong electric field between the metering element and the photoconductor-surface. Other copying conditions remain unchanged. There is no sound explanation for this result. No process occurs to meter the developer liquid by charges, as described in German Offenlegungsschrift No. 2,739,104. In this German reference, charges are sprayed from an exposed corona onto the surface of the liquid. These charges could effect an adjustment of the layer of liquid on the photoconductor. This is not similar to the present invention where the surprising result could not be expected by a person skilled in the art. The known art only teaches the application of a potential on the order of 300 V to achieve back- ground-free development. This potential is considerably smaller than the potential of approximately 950 V, existing at the image points on the photoconductive layer.

BRIEF DESCRIPTION OF THE DRAWINGS

In the following text, the invention is described in more detail; reference is made to the accompanying drawings, in which.

DETAILED DESCRIPTION OF THE PREFERRED EMBODIMENT

Figure 1:
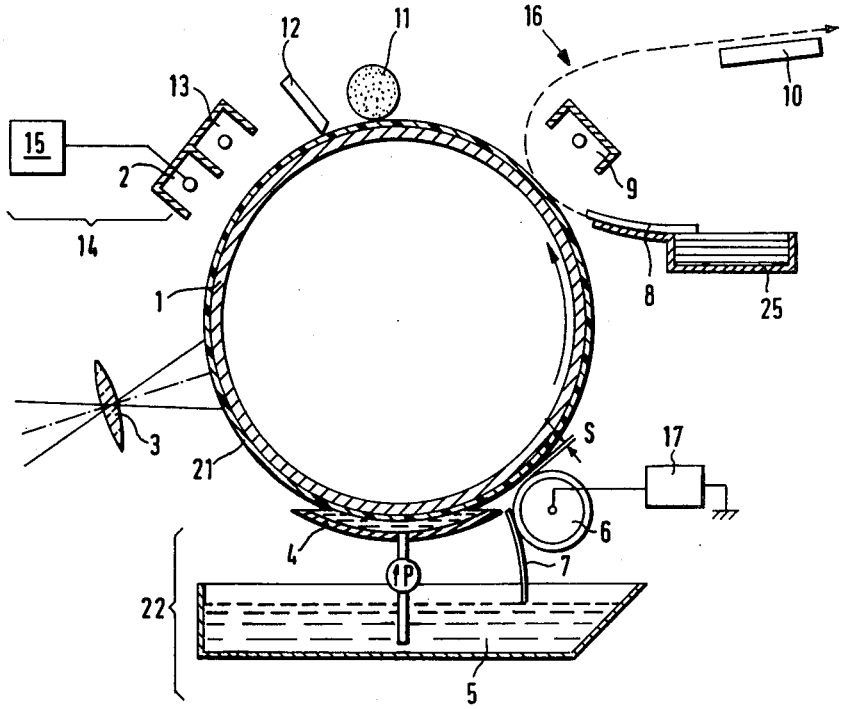
FIG. 1 shows a diagrammatic side view of an electrophotographic copier for carrying out the process according to the invention.

A copier with which the process of the present invention can be carried out is constructed in accordance with the state of the art and is diagrammatically represented in FIG. 1. A drum 1 is provided with a photoconductor 21, and is caused to rotate counterclockwise (as viewed in FIG. 1) at a preset speed by a drive source which is not represented. There are arranged round the periphery of the drum 1: an electrical charging unit 2 which can be a corona, an exposing station 3, a developing station 22, a metering roller 6 for excess developer liquid, an image-transfer station 16, a cleaning device 11, 12, and a further charging unit 13 which can be an alternating-current corona and/or a neutralizing lamp.

If the photoconductor 21 is composed of an organic material, for example of poly-N-vinylcarbazole/trinitrofluorenone, it is negatively charged by the electrostatic charging unit, while positive charges are applied if the photoconductor 21 is composed of selenium. In the exposing station 3, the charged photoconductor 21 is exposed such that information is projected onto it by an optical system, i.e. it is exposed to a ray image of an original. The electrostatic, latent charge image obtained in this manner is developed in the developing station 22 by means of a developer liquid to produce a visible toner-image. The developing station 22 comprises an arcuated plate 4, the curvature of which is matched to that of the peripheral surface of the drum 1, and a trough 5, which is filled with the developer liquid. The plate 4 serves as a developing electrode, and a defined voltage is applied to it by means of a voltage source, which is not represented. It is also possible to provide a roller instead of the arcuated plate 4. In the case of organic photoconductive layer, the toner particles dispersed in the developer liquid are positively charged, while they are negatively charged in the case of selenium layers. Most of the excess, projecting developer liquid is removed by the stripping device, which comprises the roller 6, with a scraper 7.

At the transfer station 16, copying material, for example a sheet 8 of paper, is fed from a container 25 to the drum 1. The transfer station 16 includes a charging unit 9, for example a corona, which electrostatically charges the sheet 8 of paper from the rear. In the case of a selenium photoconductor 21, the sheet 8 of paper is positively charged. It is also possible to provide a pressure roller (not shown) instead of the charging unit 9. This pressure roller bears against the peripheral surface of the drum 1 and is connected to a voltage source which charges it to a potential suitable for the transfer operation. Following the transfer of the toner-image from the photoconductor 21 onto the sheet 8 of paper, the sheet 8 is detached from the peripheral surface of the drum 1 and is drawn over a heating device 10, which dries the still moist toner-image.

The cleaning device comprises a roller 11, for example a roller made of a foamed material, and a wiperblade 12, which is located in the immediate vicinity of the roller 11. The roller 11 is wetted with developer liquid and, together with the wiper-blade 12, cleans toner residues from the surface of the photoconductor.

The charging unit 13 removes all residual charges from the photoconductor 21, so that the latter is completely discharged.

In known copiers, when the photoconductor 21 is selenium, an operating voltage of +6.3 kV is supplied to the direct-current corona 2. The photoconductive layer composed of selenium, which is approximately 50 μm thick, and has been charged to a maximum of about +1,150 V, is discharged in accordance with the quantity of light which is supplied in the exposing station 3. Toner particles are then deposited corresponding to the residual charge which is present on the photoconductive layer, whereby the latent charge image is developed into a toner image.

The charging unit 14 comprises the direct-current corona 2 connected to a high-voltage circuit 15. In order to carry out the process according to the invention, the high voltage circuit 15 is designed to continuously operate the direct-current corona 2 at a voltage of 8 kV.

The metering roller is composed of aluminum having an anodized surface, and rotates counter to the rotation of drum 1 at a peripheral speed which is three times as high as that of the drum 1 at a distance of 50 μm from the latter. At the ends of its projecting shaft-stubs, the metering roller 6 carries running rollers (not shown) made of insulating material. The running rollers have internally-fitted roller bearings which are mounted in endshields to permit rotation. The gap S between the metering roller 6 and the photoconductor-surface is determined by the choice of the diameter of the roller, which bears firmly against the photoconductor-surface on the drum 1. A voltage source 17 is connected to the metering roller 6.

Figure 2:
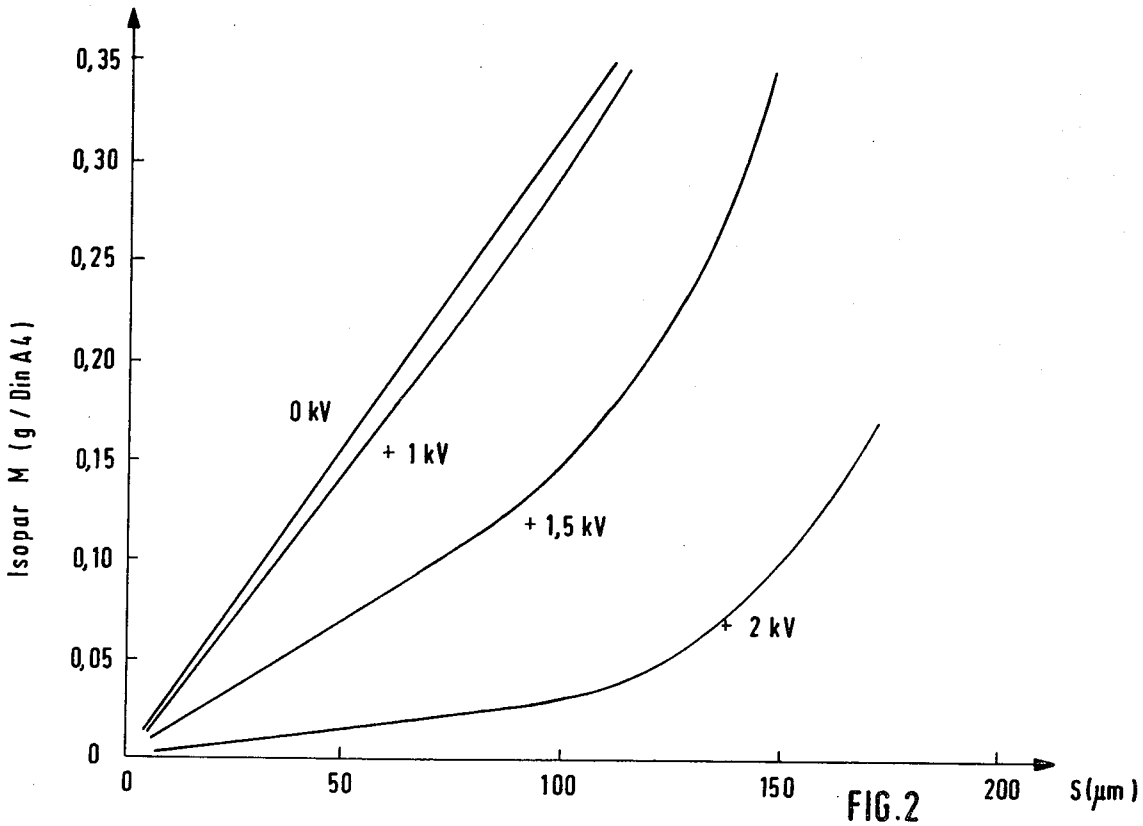
FIG. 2 shows the variation of the quantity of developer liquid which is lost, as a function both of the voltage applied to the metering element and of the gap between the metering element and the photoconductor-surface.

The quantity of developer liquid lost per DIN A4 copy is plotted in FIG. 2 as a function of the size of the gap between the metering roller 6 and the photoconductor-surface. The four curves shown in FIG. 2 represent four different voltages applied to the metering roller 6. If Isopar M is used as the developer liquid, with particles of Infotec® toner dispersed therein, the curve-shapes shown in FIG. 2 are thus obtained. Isopar M is a liquid isoparaffinic hydrocarbon, which boils at 223° C.

In order to determine the quantity of Isopar M which is lost to the copies, the fixing station of the copier is switched off and a number of copying sheets are weighed, before and after passing through the copier. Various voltages between 0 and +2 kV are successively applied to the metering roller 6. As can be seen, when no voltage is applied to the metering roller 6, the quantity of developer liquid which is lost increases linearly with the width of the gap S. Virtually the same state of affairs results when a voltage of +1 kV is present on the metering roller 6. These two curves in FIG. 2 show that no significant effects relevant to the reduction of the loss of developer liquid occur at voltages on the metering roller 6 of less than +1 kV. For widths of the gap S between 50 μm and 130 μm, the voltages must exceed +1 kV, for example +1.5 kV, before a significant reduction in the loss of developer liquid manifests itself. At such voltages, the loss is approximately halved in the gap-range from 50 μm to 110 μm, and a reduction of 42% results even on increasing the width of the gap S to 130 μm.

Particularly favorable conditions result when the metering roller 6 is operated at a voltage of +2 kV. At +2 kV, the loss of developer liquid is reduced for gap-widths up to 150 μm to 1/5 or less of the value which results when no voltage is applied to the metering roller 6. Even at a gap of 200 μm, the resulting reduction in the loss still amounts to approximately 30%, compared to operation with a metering roller 6 to which no voltage is applied.

Similar results are obtained with an organic photoconductor when negative voltages are applied to the metering roller 6. Negative voltages are necessary because, in this case, the copier is operated with toner which is positively charged.

The influence of the speed at which the metering roller 6 rotates counter to the photoconductor on the loss of developer liquid is reduced by the high voltage on the metering roller 6. For example, the loss is reduced by only 20 to 30% when the metering roller 6 rotates counter to the photoconductor at a peripheral speed which is 1.5 times that of the photoconductor, instead of a peripheral speed which is higher by a factor of 3 to 3½. Even if the metering roller 6 is rotated in the same direction as that of the photoconductor, the reduction in the loss of developer liquid is considerable if a high voltage is applied, provided that the developer liquid which is pulled off by the metering roller 6 is removed from the surface of the roller by means of a cleaning device, such as, for example, the wiper-blade 7 in FIG. 1.

When liquid toner composed of a dispersion of negatively charged toner particles in developer liquid is used, background-free copies are obtained when a positive voltage is applied to the metering roller 6. These copies exhibit loss values which, for various voltages and gap-widths, are indicated in FIG. 2. When a voltage of +1.5 kV is applied, the copies lack contrast, but are still legible; however, their contrast is no longer adequate when a voltage of +2 kV is applied. Using a positively-charged photoconductor composed of selenium under the conditions previously specified, with negative voltages on the metering roller 6, copies which are black over their entire area are obtained accompanied by a similarly reduced loss of developer liquid. From these results, it follows that the quantity of developer liquid which is lost is, on the whole, independent of the polarity of the voltage which is applied to the metering roller 6, but the copy quality, or the toner density of the copies, is polarity-dependent.

Correspondingly, in the case of photoconductors which are composed of organic materials, such as poly-N-vinylcarbazole and trinitrofluorenone, which must be negatively charged, negative voltages must be applied to the metering roller 6 in order to obtain background-free copies which are black over their entire area, accompanied by a low loss of developer liquid.

Measures which are suitable for improving the image-contrast must enable the particles of toner to be rapidly deposited onto the charged points on the photoconductor in a stable and dense manner. To improve these characteristics, instead of an electrode 4 in the form of a sheet, it is possible to use an applicator-roller for applying the toner. The applicator-roller is positioned approximately 50 μm from the photoconductor and continuously feeds fresh developer liquid to the photoconductor. Use of such a roller inhibits premature depletion in the layer of developer liquid in direct contact with the photoconductor as a result of the earlier deposition of toner particles. The strong electric field resulting from the small clearance of only 50 μm promotes rapid deposition of the toner particles. In this manner, easily readable, background-free copies having a density of 0.65 are obtained. The toner-density is defined by the logarithm of the ratio of the amount of light which is reflected without being weakened, and the amount of light which is reflected onto the copy from the developed toner-image. If a voltage of +1.5 kV is applied to a metering roller positioned 50 μm from a selenium photoconductor, the loss of developer liquid to the copies is approximately 0.065 g per DIN A4 copy. If the metering roller is connected to ground, that is to say if no voltage is applied to it, the loss then amounts to approximately 0.16 g per DIN A4 copy.

The stability of the toner-images which are deposited on the photoconductor can be further increased by means of an additional developing electrode (not shown) located between the point at which the developer liquid is applied and the metering roller. Charging the photoconductive coating to voltages in excess of the charging voltage $U_{maxD}$ is an effective measure for increasing the stability of the toner images on the photoconductor. $U_{maxD}$ is defined as the voltage at which copies of maximum toner density are obtained in accordance with the state of the art. According to this definition, the maximum charging voltage for a photoconductive layer composed of selenium 50 μm thick is +1,150 V. If the corona-voltage for the charging process is raised from 6.3 kV to +8 kV, the photoconductive selenium layer is thereby charged to approximately +1,800 V. The toner images which are then deposited are not removed even by a metering roller at a potential of +2 kV. Under these conditions, it is merely necessary to raise the voltage of the transfer corona, in the transfer station, from +6.3 kV to +7.5 kV. If, instead of a transfer-corona, a transfer-roller is used, it is thus necessary to raise its potential by a corresponding amount. The copies produced under these copying conditions, using a gap of 50 μm, exhibit optical densities of between 0.9 and 1.1. The copies themselves are dry, for the content of Isopar M developer liquid amounts to only approximately 0.015 g per DIN A4 copy.

Without the application of a voltage to the metering roller 6, 0.16 g of developer liquid are lost per DIN A4 copy.

In the case of a metering-gap of 110 μm, and when a potential of +2 kV is applied to the metering roller 6, 0.035 g of developer liquid is lost per DIN A4 copy, and 0.350 g is lost per DIN A4 copy when the metering roller 6 is operated without a voltage.

Similar specific developer-liquid loss values are obtained with DIN A1 copies, when the photoconductive drum has a length of 80 to 105 cm.

Under otherwise identical copying conditions, the reductions in the loss of developer liquid which can be achieved with pure developer liquids somewhat exceed those in the case of liquid developers containing toner particles. This can be due to different conductivities, since pure developer liquids possess specific conductivities of between $10^{-13}$ $Ohm^{-1}$ $cm^{-1}$ to $10^{-15}$ $Ohm^{-1}$ $cm^{-1}$, whereas developer liquids containing dispersed toner particles possess specific conducitivies in the region of $10^{-11}$ $Ohm^{-1}$ $cm^{-1}$.

The loss of developer liquid of 0.015 g per DIN A4 copy, associated with a metering gap of 50 μm, is remarkably low. The original for a copy of this type possesses a coverage by black type-symbols or image-markings of 7%. In the case of a completely white original, the loss of developer liquid amounts, under otherwise identical conditions, to only 0.003 g to 0.004 g per DIN A4 copy.

In the case of an original with a coverage of 7%, a loss of developer liquid approximating to 0.01 g per DIN A4 copy appears to be the smallest quantity which is required in order to impart a pasty consistency to the toner particles which are deposited on the photoconductor. This pasty consistency is required for the transfer process onto the image-receiving material.

What is claimed is:

1. An electrophotographic copying process, comprising:

electrostatically charging a photoconductor surface;

exposing the charged photoconductor surface to an information carrying original to obtain a latent charge image on the photoconductor surface;

developing the latent charge image by applying a developer liquid to the photoconductor surface to obtain a toner image;

removing excess developer liquid by applying a bias voltage having an absolute value greater than 1 kV is equal to or higher than the absolute value of the voltage on the charged photoconductor surface, and having a polarity the same as that of the voltage on the charged photoconductor surface to a metering element positioned a short distance from the photoconductor surface and moving the metering element and photoconductor surface relative to one another;

transferring the toner image from the photoconductor surface to a copying material and fixing the toner image on the copying material; and cleaning the photoconductor surface.

2. The electrophotographic copying process as claimed in claim 1, wherein the step of removing excess developer comprises applying a biasing voltage to said stripping element which is within 200 volts of the maximum voltage on the photoconductor surface.

3. The electrophotographic copying process as claimed in claim 1, wherein the step of removing excess developer comprises applying a biasing voltage to said stripping element which has an absolute value in the range from 1.5 kV to 2.0 kV.

4. The electrophotographic copying process as claimed in claim 1, wherein the step of developing comprises forming a layer of developing liquid on the photoconductor surface, and the step of removing excess developer comprises using a roller as the metering element and positioning the roller a distance from the photoconductor surface which is less than the thickness of the developer liquid layer.

5. The electrophotographic copying process as claimed in claim 1, wherein the step of electrostatically charging comprises charging the photoconductor surface to a voltage which exceeds the charging voltage $U_{maxD}$ defined as the minimum charging voltage necessary for maximum toner-densities on the copies.

6. The electrophotographic copying process as claimed in claim 4, wherein the metering element is positioned such that a metering-gap S, of 50 to 130 μm, is provided between the surface of the photoconductor and the metering roller, and the metering element is provided with a bias voltage of +1.5 kV.

7. The electrophotographic copying process as claimed in claim 4, wherein the metering element is positioned such that a metering gap S, of 50 to 200 μm, exists between the surface of the selenium photoconductor and the metering roller in association with a bias voltage, on the metering roller, of +2 kV.

8. The electrophotographic copying process as claimed in claim 1, wherein the step of removing excess developer comprises forming a metering-gap S having a length of up to 105 cm between the stripping element and the photoconductor surface.

9. An electrophotographic copying device, comprising:

a photoconductor surface;

means for electrostatically charging said photoconductor surface to form a charged photoconductor surface;

means for exposing the charged photoconductor surface to an information carrying original to form a latent charge image on the charged photoconductor surface;

means for developing the latent charge image by applying a layer of developer liquid to the charged photoconductor surface to form a toner image;

a stripping element;

means for applying a bias voltage to the stripping element having an absolute value greater than 1 kV and equal to or higher than the absolute value of the voltage on the charged photoconductor surface and having polarity the same as the polarity of the voltage on the charged photoconductor surface;

means for moving the stripping element and the photoconductor surface relative to each other at a small distance apart to remove excess developer liquid from the photoconductor surface by contacting the liquid with the stripping element;

means for transferring the toner image to a copy receiving material; and means for cleaning the photoconductor surface after the toner image has been transferred.

10. The electrophotographic copying device as claimed in claim 9, wherein the difference between the maximum voltage on the charged photoconductor-surface and the bias voltage on the stripping element is within 200 Volts.

11. The electrophotographic copying device as claimed in claim 9, wherein the bias voltage on the stripping element is in the range of from 1.5 to 2.0 kV.

12. The electrophotographic copying device as claimed in claim 9, wherein the stripping element comprises a metering roller and is located at a distance from the photoconductor surface which is less than the thickness of the layer of developer liquid on the photoconductor surface.

13. The electrophotographic copying device as claimed in claim 1, wherein the charged photoconductor surface has a voltage which exceeds the charging voltage $U_{maxD}$ for maximum toner-densities on the copies.

14. The electrophotographic copying device as claimed in claim 12, wherein said distance comprises a metering-gap S, of 50 to 130 μm, between the photoconductor surface and the stripping element and the stripping element has a bias voltage of +1.5 kV applied by said applying means.

15. The electrophotographic copying device as claimed in claim 12, wherein said distance comprises a metering-gap S, of 50 to 200 μm, between the photoconductor surface and the stripping element, and a bias voltage of +2 kV is applied by the applying means.

16. The electrophotographic copying device as claimed in claim 9 further including a metering-gap S having a length of up to 105 cm between the stripping element and the photoconductor surface.

* * * * *